US008628695B2

(12) United States Patent
Hang et al.

(10) Patent No.: US 8,628,695 B2
(45) Date of Patent: Jan. 14, 2014

(54) SURFACE-MODIFIED RUTHENIUM OXIDE CONDUCTIVE MATERIAL, LEAD-FREE GLASS(ES), THICK FILM RESISTOR PASTE(S), AND DEVICES MADE THEREFROM

(75) Inventors: Kenneth Warren Hang, Hillsborough, NC (US); Marc H. Labranche, Chapel Hill, NC (US); Barry Edward Taylor, Wake Forest, NC (US); Paul Douglas Vernooy, Hockessin, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 960 days.

(21) Appl. No.: 12/425,091

(22) Filed: Apr. 16, 2009

(65) Prior Publication Data

US 2009/0261941 A1 Oct. 22, 2009

Related U.S. Application Data

(60) Provisional application No. 61/046,258, filed on Apr. 18, 2008.

(51) Int. Cl.

| | |
|---|---|
| ***H01B 1/02*** | (2006.01) |
| ***H01B 1/12*** | (2006.01) |
| ***B05D 5/12*** | (2006.01) |
| ***H01C 1/012*** | (2006.01) |

(52) U.S. Cl.
USPC ..... 252/519.13; 252/519.3; 427/101; 427/102; 338/308

(58) Field of Classification Search
USPC ..... 252/500, 519.13, 519.3; 427/101, 102; 338/308
See application file for complete search history.

(56) References Cited

U.S. PATENT DOCUMENTS

| | | | | | |
|---|---|---|---|---|---|
| 3,776,772 | A | * | 12/1973 | Asada et al. | 428/428 |
| 4,415,624 | A | * | 11/1983 | Prabhu et al. | 428/209 |
| 4,574,055 | A | * | 3/1986 | Asada et al. | 252/514 |

FOREIGN PATENT DOCUMENTS

| | | | | | |
|---|---|---|---|---|---|
| JP | 59050032 | A | | 3/1984 | |
| JP | 08268722 | A | * | 10/1996 | C01G 55/00 |

OTHER PUBLICATIONS

PCT International Search Report, Jul. 24, 2009.

* cited by examiner

*Primary Examiner* — Mark Kopec
*Assistant Examiner* — Tanisha Diggs

(57) ABSTRACT

The invention relates to a surface-modified $RuO_2$ conductive and a lead-free powdered glass material formulated to make a paste suitable for application to the manufacture of a thick film resistor material. The resistance range that is most suitable to this invention is a resistor having 10 kilo-ohms to 10 mega-ohms per square of sheet resistance. The resulting resistors have ±100 ppm/° C. TCRs.

15 Claims, No Drawings

SURFACE-MODIFIED RUTHENIUM OXIDE CONDUCTIVE MATERIAL, LEAD-FREE GLASS(ES), THICK FILM RESISTOR PASTE(S), AND DEVICES MADE THEREFROM

FIELD OF THE INVENTION

The invention relates to a surface-modified $RuO_2$ conductive material and a substantially lead-free powdered glass material formulated to make a paste suitable for application to the manufacture of a thick-film resistor material, and resistors made therefrom. The resistance range that is most suitable to this invention is a resistor having 10 kilo-ohms to 10 mega-ohms per square of sheet resistance. The invention also relates to the methods for making such a surface-modified $RuO_2$ conductive material.

TECHNICAL BACKGROUND OF THE INVENTION

The problem of making lead-free resistors in the resistance range between 100 kilo-ohms and 10 mega-ohms is quite difficult. The difficulty is not limited to just the resistance but also extends to the temperature coefficient of resistance (TCR) being held within ±100 ppm/° C. In the normal practice of resistor formulation, many additives are known to drive the TCR more negative. With the elimination of lead content from resistors, TCRs tend to bias significantly toward the negative side. However, it is much more difficult to raise TCRs, if they are too negative. The present invention addresses these needs.

SUMMARY OF THE INVENTION

The present invention provides a composition comprising: (a) one or more coated ruthenium-containing components, wherein the ruthenium-containing component comprises one or more components selected from the group consisting of: ruthenium oxide and ruthenium oxide hydrate, and wherein the coating comprises one or more acidic components, one or more basic components, or a combination thereof; (b) one or more glass frits; and (c) an organic vehicle. In an embodiment of the invention, the one or more acidic components comprise one or more compositions selected from the group consisting of: B, F, P, and Se. In a further embodiment of the invention, the one or more basic components comprise one or more compositions selected from the group consisting of: Li, Na, K, Rb, Cs, Mg, Ca, Sr, and Ba. In an embodiment of the invention, the ruthenium-containing component comprises $RuO_2$.

In embodiments of the present invention, the glass frit of the composition is substantially free of lead. The glass frit in accordance with the invention may comprise an alkaline earth oxide. The alkaline earth oxide may be 12-54 wt. %. The glass frit may further comprise one or more components selected from the group consisting of: $SiO_2$ 3-37 wt. %, $Al_2O_3$ 3-13 wt. %, and $B_2O_3$ 11-38 wt. %. The glass frit may further comprise one or more component selected from the group consisting of: $ZrO_2$ 0-6 wt. %, and $P_2O_5$ 0-13 wt. %. In a further embodiment of the present invention, the barium oxide may be 0-54 wt. %. The strontium oxide may be 0-38 wt %. The glass frit may further comprise one or more components selected from the group consisting of: $SiO_2$ 18-29 wt. %, $Al_2O_3$ 5-9 wt. %, and $B_2O_3$ 14-27 wt. %. The glass frit may further comprise one or more components selected from the group consisting of: $ZrO_2$ 0-3 wt. %, $K_2O$ 0-2 wt %. The basis of the weight percent for all the ranges given in this paragraph is the glass frit.

In an embodiment of the present invention, the glass frit comprises an alkaline-earth borosilicate glass. The alkaline-earth borosilicate glass may comprise an alkaline-earth boro-alumino-silicate glass. The glass frit may be substantially free of one or components selected from the group consisting of alkali metals and ZnO. The glass frit may be selected from Table 1. In an embodiment of the present invention, the composition may further comprise one or more compositions selected from the group consisting of: CuO, $TiO_2$, $SiO_2$, $ZrSiO_4$, $Ta_2O_5$, $Nb_2O_5$, $MnO_2$ and $Ag_2O$.

An embodiment of the present invention relates to a resistor comprising the composition described above. The sheet resistance of the resistor may be between 10 kilo-ohms to 10 mega-ohms per square. The TCR of the resistor may be between −100 ppm/° C. to +100 ppm/° C.

A further embodiment of the invention relates to a method of making a resistor comprising: a) coating a ruthenium oxide or ruthenium oxide hydrate compound with an acidic or a basic element; b) calcining said coated ruthenium compound; c) mixing the calcined compound with glass frit(s) and organic vehicles to form a paste; and d) printing and firing the paste to form a thick-film resistor. The acidic elements may comprise B, F, P, Se, or combinations thereof. The basic elements may comprise Li, Na, K, Rb, Cs, Mg, Ca, Sr, Ba, or combinations thereof. Additional, non-acidic or non-basic elements may be added to the coating, such as Ag, Al, Cu, Nb, Si, Ta, Ti, Zn, Zr, or combinations thereof. In an aspect, the coating process may be spray drying, incipient wetness, or precipitation of the desired element(s) on the surface of the ruthenium compound. In the preparation of the coated ruthenium oxide, the concentration of the coating element or elements is adjusted with the temperature and retention time, during its thermal treatment, to affect a suppression of grain growth of the ruthenium oxide material. This is typically measured by the retention of a surface area measurement value following calcination of from 5 to 25 $m^2/g$ changed from its higher starting value prior to calcination. This coating level may be adjusted in one embodiment of the present invention from 2000 to 15000 ppm. In yet another embodiment this coating range is 3000 to 10000 ppm. A range of coating of from 4000 to 8000 ppm may also be used in accordance with the present invention.

In an embodiment of the invention, the glass frit may be substantially free of lead. The glass frit may comprise an alkaline-earth borosilicate glass. The glass frit may comprise an alkaline-earth boro-alumino-silicate glass. The glass frit may be substantially free of alkali metals. The glass frit is selected from the list given in Table 1.

In an embodiment of the invention, the resulting surface area of the coated ruthenium oxide or ruthenium oxide hydrate, after calcination, may be between 5 and 25 $m^2/g$. The coated ruthenium compound may be calcined at a temperature of 800 to 1100° C. for a time period between 15 minutes and 12 hours. In an embodiment of the invention, the ruthenium oxide compound may be $RuO_2$. In another embodiment of the invention, the $RuO_2$ may have a surface area of >25 $m^2/g$. In an embodiment, the ruthenium oxide hydrate compound may be in the form of a wet cake obtained by the filtering of a precipitated ruthenium oxide hydrate or ruthenium hydroxide.

An embodiment of the present invention relates to resistors made by methods described herein. The finished resistor may have a sheet resistance from 10 kilo-ohms to 10 mega-ohms per square. The finished resistor may have a TCR in the range of −100 ppm/° C. to +100 ppm/° C.

In an embodiment of the present invention, the resistor may be fired at a peak temperature of 820 to 950° C.; or alternately, from 850° C. to 900° C.

DETAILED DESCRIPTION OF THE INVENTION

Ceramic thick-film resistor systems commonly include individual decade members which range between 10 ohms/sq. and 1 mega-ohm/sq. Currently, most commercial thick-film resistor systems contain either lead frits or lead frits plus lead conductive phases. The loss of positive TCR position that comes with the removal of lead materials makes the achievement of resistors having sheet resistance values of 100 kilo-ohm/sq. or greater quite difficult.

The present invention addresses the need for a conductive-oxide/frit combination (Pb-free) suitable for making thick-film resistor compositions in the 100 kilo-ohm to 10 mega-ohm/sq. range with ±100 ppm/° C. TCR. Resistors in this new series must be insensitive enough to variations in thermal process conditions to be used on high speed manufacturing lines. The present invention addresses the need for the development of suitable high-ohm resistors.

The difficult problem of attaining a high-resistance member using a conventionally recognized conductive such as $RuO_2$ is that it is prone to particle size growth during the firing in a typical resistor formulation consisting of glass powder, conductive powder, and oxide powder additives. We have surprisingly discovered that by coating the surface of a high-surface-area $RuO_2$ powder with various acidic or basic materials and then thermally processing the material in a suitable container, otherwise known as "calcining" the material, that the particle size growth typically observed, when the material is fired to temperatures in the range of 850 to 1100° C., can be suppressed. This attenuation of growth of the conductive in turn leads to specific performance advantages otherwise not attainable when used in formulated resistors.

The coated and calcined $RuO_2$ maintains its fine particle size and high surface area during the calcination and subsequent resistor firing. If alkali content above a few percent is present in the glass composition, the conductive effectively reverts to the properties typical of $RuO_2$ resistors (uncoated), making them unsuitable for high-ohm application. The resistor TCRs also shift out of the desired range. For this reason, the compositions described herein, containing the described conductive and the glass materials used to formulate a thick-film resistor, are able to achieve an acceptable set of resistor properties.

$RuO_2$ normally undergoes particle growth, with concomitant loss of surface area, when fired above 600° C. This sintering causes large variations in R and TCR when $RuO_2$-based resistors are fired in the temperature range 8000 to 900° C. Large thermal process variations result in low yields in large volume chip resistor manufacture. A coated $RuO_2$, as described herein, greatly reduces thermal process sensitivity of these $RuO_2$-based resistors.

As described herein, the high-surface-area $RuO_2$ or $Ru(OH)_4.nH_2O$ is coated, at a minimum, with either a basic ion (such as $K^+$ or $Ba^{2+}$) or an -acidic ion (such as $BO_3^{3-}$ or $PO_4^{3-}$). Optionally, additional ions can be included in the coating. The coated $RuO_2$ is then calcined at a temperature between 800° and 1100° C. The coating and calcination process is designed to produce fine particle, crystalline $RuO_2$ with relatively high surface areas (>5 $m^2/g$).

When this coated $RuO_2$ is combined with an alkaline-earth alumino-borosilicate frit, $RuO_2$-based high-ohm resistors can be produced. Surprisingly, the electrical performance of the resistors in accordance with the invention is comparable to lead-containing resistors that use lead ruthenate in leaded frits, 100 kilo-ohm to 10 mega-ohm/sq. Resistance values with ±100 ppm/° C. Hot and Cold TCR (HTCR/CTCR) can be achieved when making a resistor in accordance with the methods and/or compositions of the present invention.

The compositions of glasses prepared and tested as powdered glass constituents of a resistor formulation are shown in Table 1. The glass precursors were melted, quenched by roller, and milled to a mean particle size of 1 to 1.5 microns.

In the present invention, "substantially free of lead" means not containing any lead above the level of an impurity. The level of an impurity (for example, a content in the glass composition of 0.05 wt % or less) may be contained. Lead is sometimes contained in extremely small amounts as an unavoidable impurity in the glasses in accordance with the invention or in other compositional elements of the resistor paste and the resistor.

In the present invention, "substantially free of either alkali metals, or ZnO, or both" means not containing any alkali metals, or ZnO above the level of an impurity. Alkali metals and ZnO are sometimes contained in extremely small amounts as an unavoidable impurity in the glasses in accordance with the invention or in other compositional elements of the resistor paste and the resistor.

Preparation of Glass Frits

The glasses were melted in platinum rhodium alloy crucibles at a temperature in the range of 1350 to 1550° C. The batch materials were oxide materials with the exception of barium carbonate, strontium carbonate, calcium carbonate, and potassium carbonate. The batch materials were weighed and mixed thoroughly before melting. The phosphorous pentoxide was added in the form of a pre-reacted phosphate compound, such as $Ba_2P_2O_7$, $BaP_2O_6$, or $BPO_4$; however, the choice would not have to be limited to these exemplary compounds. The boron was added as boric anhydride. Amorphous silica was used as the source of $SiO_2$. The glass was melted for 1 to 4 hours, stirred, and quenched. The glass was quenched. The glass was then ball milled in water to a 5 to 7 micron powder using ½" zirconia media. The glass slurry was screened through a 325-mesh screen. The slurry was dried at 100° C. and then milled again in water to a final d50 size of about 1 to 1.5 micron. The dried glass powder was then baked to 175° C. and was then ready to be used in resistor formulation. The drying step was used to remove surface moisture.

The general compositional range of the glasses listed in Table 1 is $SiO_2$ 3-37 wt. %, $Al_2O_3$ 3-13 wt. %, $B_2O_3$ 11-38 wt. %, alkaline-earth oxide 12-54 wt. %, with optional additions of $ZrO_2$ 0-6 wt. % and/or $P_2O_5$ 0-13 wt. %. Additional glass compositions are shown in Table 2 to illustrate the influence on resistor properties by glasses that are related to those in Table 1 but contain added alkali metal oxides, zinc oxide and/or titanium oxide. In some cases, property shifts can be seen in resistors formulated with glasses containing these or other modifiers. Additional materials may be added to the glass materials in accordance with the invention such as other metal oxides, glass forming oxides, refractory glass powders and crystalline oxides. Additionally, the use of blends of differing glass compositions in the formulation of resistor pastes and resistors is possible in accordance with the present invention.

TABLE 1

| Glass Compositions | | | | | | | | | |
|---|---|---|---|---|---|---|---|---|---|
| ID | Weight % SiO2 | Al2O3 | ZrO2 | B2O3 | CaO | BaO | SrO | P2O5 | Density g/cc |
| 1 | 24.08 | 9.43 | | 20.93 | | 27.19 | 18.37 | | 3.35 |
| 2 | 23.28 | 5.54 | 1.81 | 22.70 | | 46.67 | | | 3.47 |
| 3 | 24.39 | 5.59 | | 22.91 | | 47.10 | | | 3.47 |
| 4 | 22.25 | 7.55 | | 19.89 | | 50.30 | | | 3.56 |
| 5 | 20.84 | 6.32 | | 19.57 | | 53.26 | | | 3.61 |
| 6 | 29.44 | 9.99 | | 26.32 | 12.66 | | 21.59 | | 2.89 |
| 7 | 25.46 | 6.42 | 5.24 | 26.32 | | | 36.56 | | 3.10 |
| 8 | 36.61 | 3.04 | | 23.73 | | | 36.62 | | 3.03 |
| 9 | 25.63 | 6.47 | | 25.01 | | | 36.81 | 6.08 | 2.99 |
| 10 | 26.30 | 6.83 | | 29.85 | | | 37.02 | | 3.04 |
| 11 | 26.30 | 6.83 | | 29.85 | | | 37.02 | | 3.84 |
| 12 | 27.43 | 6.53 | 2.13 | 26.75 | | | 37.16 | | 3.09 |
| 13 | 13.49 | 4.58 | 3.32 | 35.01 | | | 37.22 | 6.37 | 3.09 |
| 14 | 28.79 | 6.60 | | 27.04 | | | 37.57 | | 3.06 |
| 15 | 25.76 | 9.32 | | 27.17 | | | 37.75 | | 3.13 |
| 16 | 7.55 | 6.87 | | 34.39 | | | 39.08 | 12.11 | 3.05 |
| 17 | 26.50 | 10.11 | | 22.92 | | | 40.47 | | 3.15 |
| 18 | 7.02 | 7.23 | 5.14 | 29.06 | | | 43.25 | 8.29 | 3.29 |
| 19 | 25.15 | 8.07 | | 23.33 | | | 43.45 | | 3.22 |
| 20 | 18.99 | 10.17 | | 24.31 | | | 46.53 | | 3.28 |
| 21 | 34.78 | 7.98 | | 32.68 | 24.57 | | | | 2.58 |
| 22 | 26.24 | 8.62 | | 31.86 | 33.28 | | | | 2.73 |

Conductive Coating Process

Coating can be done by any technique known to those skilled in the art, such as spray drying, incipient wetness, rotovapping, precipitation, etc. The method described here is incipient wetness.

The $RuO_2$ used was a fine powder with a surface area of 20 to 60 $m^2/g$. The volume of solution that just wets the powder was ascertained, either by measuring the pore volume, or by adding known quantities of liquid to a test sample until the powder is just wetted. For instance, the $RuO_2$ used in the examples required ~116 ml of water to wet 100 g of powder. A solution of the coating element or elements was prepared and diluted to the appropriate volume. For instance, if the desired concentration of K was 5000 ppm, 8.84 g of a 10 wt. % $K_2CO_3$ solution was diluted to 116 ml. This solution was mixed thoroughly with 100 g of $RuO_2$ and then dried and calcined.

Other forms of high-surface-area $RuO_2$ can be used, as well. For instance, the wet cake obtained from the precipitation and filtering of $Ru(OH)_4.nH_2O$ can be used as is, without first drying it. In this case, the coating solution should be more concentrated than in the case of a dry powder, since the wet cake already contains a large amount of water.

The coating solution can be obtained by dissolving a soluble form of the desired element(s) in a suitable solvent, preferably water or a mixture of water and a water-miscible solvent, such as methanol. Suitable salts for cationic elements are nitrates, acetates, nitrites, sulfates, carbonates, or any others which have sufficient solubility. For anionic elements, such as P, B, or F, their acid form ($H_3PO_4$, for instance) or their ammonium salts are used.

If the coating consists of two or more elements, they are combined in one solution (if both are simultaneously soluble), or they could have been sequentially added to the $RuO_2$ with a drying step in between. As long as one of the elements was acidic or basic, and in the proper concentration, additional elements could have been be added while maintaining a high surface area after firing. These additional elements might, for instance, be used to adjust R, TCR, or other resistor properties.

The mixing of the liquid with the powder can be done in any practical way that ensures that all the powder is wetted and the resulting high-solids slurry is uniform, such as with a high-sheer mixer or kneader.

The drying of the high-solids slurry can be done by any convenient means. For instance, the paste can be air dried at room temperature or heated to accelerate the drying. Static or forced-air drying can be used.

The dried high-solids slurry was calcined at a temperature of 800° C. to 1100° C. for 15 minutes to 12 hours. Time and temperature were optimized for any given coating and ruthenium compound to achieve the desired resistor properties. Air could be used to maintain Ru in the 4+ oxidation state, but other atmospheres, such as steam, nitrogen, or argon could be used.

The powder may be sieved after the drying and firing steps to produce a fine, free-flowing powder.

Paste Formulation

The mixture of particles and frit can be fabricated into a resistor by making a thick-film paste. The procedures for making such a paste are known in the art. Typically, the paste consists of conductive particles, glass powder, and optional additives dispersed in an organic medium to produce a screen-printable paste. The resistance of individual resistor pastes can be varied by changing the chemistry of the conducting phase (i.e., Ag/Pd solid solution powders for resistors less than 10 ohms/sq., and $RuO_2$ for resistors equal to and greater than 10 ohms/sq.), and by varying the weight ratio of the frits and conductive phases. Using a coated $RuO_2$ conductive phase and glass compositions from Table 1, resistances between 100 kilo-ohms/sq. and 1 mega-ohm/sq. can be achieved with conductive loadings between 15 and 20 weight % of the thick-film paste (the paste typically contains 70 weight % of conductive and frit). The glass powder component of the paste formulation may be partially substituted by other oxide powders, so as to influence resistor paste characteristics and the subsequent printed and fired resistor electrical properties. Examples of other types of substituted additives are refractory glass powders such as commercial E glass, Corning®7740 glass, fused silica, and Corning® 7800 glass.

The inorganic components may be mixed with an organic medium by mechanical mixing to form viscous compositions called "pastes," having suitable consistency and rheology for screen printing. A wide variety of inert viscous materials can be used as the organic medium. The organic medium should be one in which the inorganic components are dispersible with an adequate degree of stability. The rheological properties of the medium should be such that they lend good application properties to the composition, including: stable dispersion of solids, appropriate viscosity and thixotropy for screen printing, appropriate wettability of the substrate and the paste solids, a good drying rate, and good firing properties. The organic medium used in the thick-film composition of the present invention may be a non-aqueous inert liquid. Use can be made of any of various organic mediums, which may or may not contain thickeners, stabilizers, and/or other common additives. The organic medium is typically a solution of polymer(s) in solvent(s). Additionally, a small amount of additives, such as surfactants, may be a part of the organic medium. The most frequently used polymer for this purpose is ethyl cellulose. Other examples of polymers include ethyl hydroxyethyl cellulose, wood rosin, mixtures of ethyl cellulose and phenolic resins, polymethacrylates of lower alcohols, and monobutyl ether of ethylene glycol monoacetate can also be used. The most widely used solvents found in thick-film compositions are ester alcohols and terpenes such as alpha- or beta-terpineol or mixtures thereof with other solvents such as kerosene, dibutylphthalate, butyl carbitol, butyl carbitol acetate, hexylene glycol, and high-boiling alcohols and alcohol esters. In addition, volatile liquids for promoting rapid hardening after application on the substrate can be included in the medium. Suitable surfactants for $RuO_2$-based resistors include soya lecithin and alkali phosphates. Various combinations of these and other solvents are formulated to obtain the viscosity and volatility requirements desired.

In an embodiment of the invention, the polymer present in the organic medium is in the range of 8 weight % to 11 weight % of the total composition. The thick-film resistor composition of the present invention may be adjusted to a predetermined, screen-printable viscosity with the organic medium (described below).

The ratio of organic medium in the thick-film composition to the inorganic components in the dispersion is dependent on the method of applying the paste and the kind of organic medium used, and it can vary. Usually, the dispersion will contain 70 to 95 weight % of inorganic components and 5 to 30 weight % of organic medium in order to obtain good wetting.

The powders are wetted by the organic medium by mechanical mixing. Small samples can be hand mixed on a glass surface with a spatula. Impeller stirrers are used for larger volumes of paste. Final mixing and dispersion of powder particles is accomplished by the use of a three-roll mill such as the Ross (Hauppauge, N.Y.) three-roll mill (floor model with 4 inch (10.16 cm) diameter×8 inch (20.32 cm) long rolls). A final paste viscosity between 150 and 300 Pa-sec. is suitable for screen printing (as measured at 10 rpm and 25° C. with a Brookfield HBF viscometer [Middleboro, Mass.] with #14 spindle and 6R cup). Screen printing is accomplished using an automatic screen printer (such as those from Engineering Technical Products, Sommerville, N.J.). Either 200 or 325 mesh stainless steel screens are used to achieve resistor dried thickness of 18 microns (on resistors with 0.8 mm. length and width). The resistors are printed on 1 inch (2.54 cm) squares of 96% alumina substrates. The substrates are 25 mils (0.635 mm) in thickness and are produced by CoorsTek (Golden, Colo.). The resistors are printed on a pattern of Ag thick-film terminations which had been previously fired to 850° C. DuPont 5435F terminations were fired using the recommended 30 minute firing profile with 10 minutes at the peak firing temperature (DuPont MicroCircuit Materials, Wilmington, Del.). Resistors are also fired at 850° C. using a 30 minute profile with 10 minutes at the peak temperature. A Lindberg Model 800 (Riverside, Mich.) 10-zone belt furnace with 233.5 inch (593.1 cm) belt length is used for all firings.

Resistances are measured at −55, 25, and 125° C. using a two-point probe method. A Keithley 2000 multimeter and Keithley 224 programmable current source (Cleveland, Ohio) are used to carry out the measurements. An S & A Engineering 4220AQ thermal test chamber (Scottsdale, Ariz.) is used to achieve the three measurement temperatures. Data is reported as R/sq. at 25° C. CTCR is defined as $[(R_{25°\ C.}-R_{-55°\ C.})/(\Delta T\times R_{25°\ C.})]\times 1{,}000{,}000$. HTCR is defined as $[(R_{125°\ C.}-R_{25°\ C.})/(\Delta T\times R_{25°\ C.})]\times 1{,}000{,}000$. The units of both HTCR and CTCR are ppm/° C.

Materials

The ruthenium compounds were obtained from Colonial Metals, Elkton, Md. All other inorganic chemicals were obtained from Sigma-Aldrich (St. Louis, Mo.). The amorphous $SiO_2$ used in resistor formulation has a surface area of about 10 $m^2/g$.

Conductive Processing (CP) EXAMPLES

Example CP-1

5,000 ppm K 6.4795 g of a 3.8554 wt. % $KHCO_3$ solution was diluted to 64.48 g. The solution was thoroughly mixed with 49.96 g of $RuO_2$. The $RuO_2$ had a starting surface area of 59 $m^2/g$. The high-solids slurry was allowed to air dry. The dried high-solids slurry was crushed to a fine powder and calcined 1 hour at 900° C. The resulting coated $RuO_2$ had a surface area of 12.40 $m^2/g$.

Example CP-2

6,000 ppm K and 4,753 ppm P 7.3168 g of a 10.00 wt. % $KH_2PO_4$ solution was diluted to 42.37 g. The solution was thoroughly mixed with 35.12 g of $RuO_2$. The $RuO_2$ had a starting surface area of 59 $m^2/g$. The high-solids slurry was allowed to air dry. The dried high-solids slurry was crushed to a fine powder and calcined 1 hour at 1050° C. The resulting coated $RuO_2$ had a surface area of 10.22 $m^2/g$.

Example CP-3

10,000 ppm Rb 7.7445 g of a 6.1258 wt. % $Rb_2CO_3$ solution was diluted to 42.37 g. The solution was thoroughly mixed with 35.11 g of $RuO_2$. The $RuO_2$ had a starting surface area of 59 $m^2/g$. The high-solids slurry was allowed to air dry. The dried high-solids slurry was crushed to a fine powder and calcined 1 hour at 900° C. The resulting coated $RuO_2$ had a surface area of 10.34 $m^2/g$.

Example CP-4

2.5% B

A wet cake of precipitated $Ru(OH)_4nH_2O$ was filtered but not dried. 15.5417 g of a 4.9951 wt. % $H_3BO_3$ solution was thoroughly mixed with the cake. The high-solids slurry was allowed to air dry. The dried high-solids slurry was crushed to a fine powder and calcined 1 hour at 900° C. The resulting coated $RuO_2$ had a surface area of 10.08 $m^2/g$.

Example CP-5

6,000 ppm P 6.3942 g of an 8.817 wt. % $H_3PO_4$ solution was diluted to 43.58 g. The solution was thoroughly mixed with 34.95 g of $RuO_2$. The $RuO_2$ had a starting surface area of 59 $m^2/g$. The high-solids slurry was allowed to air dry. The dried high-solids slurry was crushed to a fine powder and calcined 1 hour at 900° C. The resulting coated $RuO_2$ had a surface area of 12.70 $m^2/g$.

Example CP-6

5,000 ppm K and 827 ppm Si $K_2SiO_3$ and KOH were dissolved in water to form a 3.4586% K and 0.5723% Si solution. 4.3427 g of this solution was diluted to 36.81 g. The solution was thoroughly mixed with 30.02 g of $RuO_2$. The $RuO_2$ had a starting surface area of 59 $m^2/g$. The high-solids slurry was allowed to air dry. The dried high-solids slurry was crushed to a fine powder and calcined 1 hour at 900° C. The resulting coated $RuO_2$ had a surface area of 8.96 $m^2/g$.

Comparative Example CP-7

No Coating

Pure, uncoated $RuO_2$ with a starting surface area of 59 $m^2/g$ was calcined 1 hour at 900° C. The resulting uncoated $RuO_2$ had a surface area of 0.86 $m^2/g$.

Resistor Formulation and Testing EXAMPLES

All test results are reported in the following units. The units of R (sheet resistance) are ohms/square for 0.8×0.8 mm resistors. TCRs are reported in ppm/° C.

Comparative Example 1

No Coating on $RuO_2$

Uncoated, calcined $RuO_2$ with a surface area of 0.86 $m^2/g$ (Example CP-7) was blended with Glass #14 (Table 1), amorphous silica, and organic medium in the following proportions to prepare two resistor formulations:

| | Resistor Paste C-1 | Resistor Paste C-2 |
|---|---|---|
| $RuO_2$ | 26.40 wt. % | 32.27 wt. % |
| Glass powder #14 | 36.55 | 31.10 |
| Amorphous $SiO_2$ | 7.05 | 6.63 |
| Organic medium | 30.00 | 30.00 |

The two resistor pastes were mixed with a high-shear mixer at 750 RPM for 5 minutes. The pastes were then roll milled on a pressure controlled roll mill with the passes as follows: 1×100 psi, 2×150 psi, 3×200 psi. The pastes were printed at 18 microns dry on eight 1"×1" alumina substrate chips pre-terminated with Ag based conductor pads. Data was collected from 8 printed resistors from each chip. The samples were fired at 850° C. All resistors from both pastes C-1 and C-2 had sheet resistance too high to measure.

Example 2

Coated $RuO_2$ with Glass #3 (Table 1)

The resistor conductive used in this test has been coated as described in the Example CP-1. The 5000 ppm K coated $RuO_2$ was formulated with Glass #3 in the following two resistor paste formulations:

| | Resistor Paste 2-1 | Resistor Paste 2-2 |
|---|---|---|
| Coated $RuO_2$ | 10.42 wt. % | 15.07 wt. % |
| Glass powder #3 | 59.58 | 54.93 |
| Organic medium | 30.00 | 30.00 |

The two resistor pastes were mixed with a high-shear mixer at 750 RPM for 5 minutes. The pastes were then roll milled on a pressure controlled roll mill with the passes as follows: 2×open, 2×100 psi, 2×180 psi, 2×250 psi. The pastes were printed at 18 microns dry on four 1"×1" alumina substrate chips pre-terminated with Ag based conductor pads. Data was collected from 8 printed resistors from each chip. The reported values are averaged. The samples were fired at 850° C. The measured sheet resistance in ohms/sq. for the resistor paste 2-1 was 10,095,400 ohms (CV %=2.81). The hot TCR (HTCR) was 92 (sigma=2.7) and the cold TCR (CTCR) was 42 (sigma=3.0). The measured sheet resistance in ohms/sq. for resistor paste 2-2 was 1,661,501 ohms (CV %=2.36). The HTCR was 37 (sigma=1.7) and the CTCR was −19 (sigma=0.8). These data indicate that a 1 mega-ohm/sq. resistor in this resistor/conductive system would have H/CTCR of +21/−37 ppm/° C., which is well within the usual ±100 ppm/° C. specification limit for thick-film resistor compositions.

Example 3

Coated $RuO_2$ with Glass #14 (Table 1) and an Oxide Additive

The resistor conductive used in this test has been prepared as described in the Example CP-1 above. The coated $RuO_2$ was formulated with Glass #14 (Table 1) in the following two resistor paste formulations:

| | Resistor Paste 3-1 | Resistor Paste 3-2 |
|---|---|---|
| Coated $RuO_2$ | 12.14 wt. % | 17.33 wt. % |
| Glass powder #14 | 49.09 | 44.69 |
| Amorphous $SiO_2$ | 8.77 | 7.98 |
| Organic medium | 30.00 | 30.00 |

The two resistor pastes were mixed with a high-shear mixer at 750 RPM for 5 minutes. The pastes were then roll milled on a pressure controlled roll mill with the passes as follows: 2×open, 2×100 psi, 2×180 psi, 2×250 psi. The pastes were printed at 18 microns dry on four 1"×1" alumina substrate chips pre-terminated with Ag based conductor pads. Data was collected from 8 printed resistors from each chip. The reported values are averaged. The samples were fired at 850° C. The measured sheet resistance in ohms/sq. for the resistor paste 3-1 was 4,484,240 ohms (CV %=3.03). The hot TCR (HTCR) was −84 (sigma=2.6) and the cold TCR(CTCR) was −160 (sigma=3.4). The measured sheet resistance in ohms/sq. for resistor paste 3-2 was 532,647 ohms (CV %=2.59). The HTCR was −104 (sigma=0) and the CTCR was −180 (sigma=0).

TABLE 2

Additional Glass Reference Compositions

| ID | Weight % SiO2 | Al2O3 | ZrO2 | B2O3 | ZnO | BaO | SrO | Na2O | K2O | TiO2 | Li2O | P2O5 | Density g/cc |
|---|---|---|---|---|---|---|---|---|---|---|---|---|---|
| 23 | 18.18 | 8.94 | | 19.41 | | 51.46 | | | 2.00 | | | | 3.59 |
| 24 | 22.40 | 9.15 | | 16.34 | | 50.81 | | | 1.30 | | | | 3.57 |
| 25 | 24.72 | 10.46 | | 18.58 | | | 45.55 | | 0.69 | | | | 3.28 |
| 26 | 27.08 | 12.31 | | 15.13 | | | 41.69 | | 3.79 | | | | 3.17 |
| 27 | 28.08 | 10.95 | | 21.11 | | | 39.27 | | 0.59 | | | | 3.07 |
| 28 | 28.22 | 8.22 | | 22.94 | | | 36.83 | | 2.42 | 1.37 | | | 3.05 |
| 29 | 36.94 | 5.49 | | 14.98 | | 35.35 | | | 7.24 | | | | 3.12 |
| 30 | 53.81 | 3.45 | | | 24.75 | | 7.00 | 7.33 | | | 1.26 | 2.40 | 2.89 |
| 31 | 24.32 | 4.57 | 2.04 | 27.23 | 5.40 | 20.34 | 13.74 | | | | | 2.35 | 3.14 |
| 32 | 23.40 | 5.37 | | 14.84 | 13.56 | 25.56 | 17.27 | | | | | | 3.66 |
| 33 | 3.29 | | | 24.85 | 20.29 | 51.58 | | | | | | | 4.15 |

Note:
Composition 30 of Table 2 is a comparative example of a glass composition not in accordance with the invention.

Example 4

Coated $RuO_2$ with Glass #33 (Table 2)

The resistor conductive used in this test has been coated as described in the Example CP-1 above with the same process conditions. The coated $RuO_2$ was calcined at 900° C. 1 hour and resulted in a surface area of 11.93 $m^2/g$. The coated $RuO_2$ was formulated with Glass #33 (Table 2) in the following two resistor paste formulations:

| | Resistor Paste 4-1 | Resistor Paste 4-2 |
|---|---|---|
| Coated $RuO_2$ | 13.05 wt. % | 8.92 wt. % |
| Glass powder #33 | 56.95 | 61.08 |
| Organic medium | 30.00 | 30.00 |

The two resistor pastes were mixed with a high-shear mixer at 750 RPM for 5 minutes. The pastes were then roll milled on a pressure controlled roll mill with the passes as follows: 2×open, 2×100 psi, 2×180 psi, 2×250 psi. The pastes were printed at 18 microns dry on four 1"×1" alumina substrate chips pre-terminated with Ag based conductor pads. Data was collected from 8 printed resistors from each chip. The reported values are averaged. The samples were fired at 850° C. The measured sheet resistance in ohms/sq. for the resistor paste 4-1 was 47,900 ohms (CV %=3.03). The hot TCR (HTCR) was −41 (sigma=3.1) and the cold TCR (CTCR) was −124 (sigma=0). The measured sheet resistance in ohms/sq. for resistor paste 4-2 was 167,532 (CV %=4.4) ohms. The HTCR was −46 (sigma=0) and the CTCR was −135 (sigma=0).

Example 5

Coated $RuO_2$ with Glass #3, #12, #2, #4, and #5 (Table 1). with Amorphous $SiO_2$ Additive The resistor conductive used in this series of tests has been coated as described in the Example CP-1 above with the same process conditions. The coated $RuO_2$ was calcined at 900° C. 1 hour and resulted in a surface area of 12.40 $m^2/g$. The 5000 ppm K coated $RuO_2$ was formulated with Glass #3, #12, #2, #4, and #5 (Table 1) in the following identical volume percent loading (12%) of coated $RuO_2$ with each of the glass materials and a constant volume % additive of amorphous $SiO_2$ (17.6%) incorporated in the following resistor paste formulations:

TABLE 3

Resistor Paste Formulation Solids in Weight %

| Sample ID | Coated $RuO_2$ | Glass #3 | Glass #12 | Glass #2 | Glass #4 | Glass #5 | Amorphous $SiO_2$ |
|---|---|---|---|---|---|---|---|
| A | 22.84 | 66.63 | | | | | 10.53 |
| B | 24.61 | | 64.05 | | | | 11.34 |
| C | 22.82 | | | 66.66 | | | 10.52 |
| D | 22.45 | | | | 67.20 | | 10.35 |
| E | 22.23 | | | | | 67.53 | 10.24 |

The solids are processed into pastes by formulating 70 weight % solids with 30 weight % organic medium. The resistor pastes were mixed with a high-shear mixer at 750 RPM for 5 minutes. The pastes were then roll milled on a pressure controlled roll mill with the passes as follows: 2×open, 2×100 psi, 2×180 psi, 2×250 psi. The pastes were printed at 18 microns dry on four 1"×1" alumina substrate chips pre-terminated with Ag based conductor pads. Data was collected from 8 printed resistors from each chip. The reported values are averaged. The samples were fired at 850° C.

TABLE 4

850° C. Fired Resistor Properties and Measurement Statistics for Samples from Table 3.

| | A | stats. | B | stats. | C | stats. | D | stats. | E | stats. |
|---|---|---|---|---|---|---|---|---|---|---|
| R | 1289830 | CV % = 3.02 | 628540 | CV % = 5.88 | 1410813 | CV % = 5.14 | 1893896 | CV % = 2.26 | 8732661 | CV % = 3.71 |
| HTCR | −11.36 | σ = 2.331 | −129.30 | σ = 3.91 | −20.97 | σ = 2.256 | 21.15 | σ = 1.663 | 65.59 | σ = 7.546 |
| CTCR | −69.02 | σ = 1.933 | −204.20 | σ = 4.979 | −78.11 | σ = 4.984 | −43.00 | σ = 2.69 | −0.02 | σ = 10.25 |

Example 6

Coated $RuO_2$ with Glass #32 (Table 2) with Amorphous $SiO_2$ Additive

Using the same resistive conductive and processing conditions as described in Example 5, the Glass #32 from Table 2 was tested under identical conditions. The resistor formulation solids were: 22.04 wt. % of the K-coated $RuO_2$, 67.80 wt. % of Glass #32 from Table 2, and 10.16 wt % amorphous $SiO_2$.

The data from the 850° C. fired samples were as follows:

| | Glass 10 | stats. |
|---|---|---|
| R | 979751.1 | CV % = 3.38 |
| HTCR | −37.6 | σ = 2.007 |
| CTCR | −118.3 | σ = 4.408 |

Example 7

Coated $RuO_2$ with Glass #23 (Table 2)

The resistor conductive used in this test has been coated as described in the Example CP-1 above. The coated $RuO_2$ was formulated with Glass #23 (Table 2) in the following resistor paste formulation:

| | Resistor Paste 7-1 | Resistor Solids |
|---|---|---|
| Coated $RuO_2$ | 15.63 wt. % | 12.00 vol. % |
| Glass powder #23 | 47.17 | 70.40 |
| Amorphous $SiO_2$ | 7.20 | 17.60 |
| Organic medium | 30.00 | |

The resistor paste was mixed with a high-shear mixer at 750 RPM for 5 minutes. The paste was then roll milled on a pressure controlled roll mill with the passes as follows: 2×open, 2×100 psi, 2×180 psi, 2×250 psi. The paste was printed at 18 microns dry on four 1"×1" alumina substrate chips pre-terminated with Ag based conductor pads. Data was collected from 8 printed resistors from each chip. The reported values are averaged. The samples were fired at 850° C. The measured sheet resistance in ohms/sq. for the fired resistor paste 7-1 was 10,531,550 ohms (CV %=4.22). The hot TCR (HTCR) was 53 (sigma=2.1) and the cold TCR (CTCR) was −3 (sigma=0). This resistor example is comparable to Example 2 (Resistor paste 2-1) with two differences. Example 7 has an amorphous $SiO_2$ additive and the glass. In resistor paste 2-1, Glass #3 (Table 1), is very similar, but without the added alkali oxide, $K_2O$.

Example 8

Coated $RuO_2$ with Glass #33 (Table 2) with Additive Amorphous $SiO_2$

The resistor conductive used in this test has been coated as described in the Example CP-1 above. The coated $RuO_2$ was calcined at 900° C. 1 hour and resulted in a surface area of 12.40 $m^2/g$. The coated $RuO_2$ was formulated with Glass #33 (Table 2) in the following resistor paste formulation:

| | Resistor Paste 8-1 | Resistor Solids |
|---|---|---|
| Coated $RuO_2$ | 14.14 wt. % | 12.00 vol. % |
| Glass powder #33 | 49.35 | 70.40 |
| Amorphous $SiO_2$ | 6.51 | 17.60 |
| Organic medium | 30.00 | |

The resistor paste was mixed with a high-shear mixer at 750 RPM for 5 minutes. The paste was then roll milled on a pressure controlled roll mill with the passes as follows: 2×open, 2×100 psi, 2×180 psi, 2×250 psi. The paste was printed at 18 microns dry on four 1"×1" alumina substrate chips pre-terminated with Ag based conductor pads. Data were collected from 8 printed resistors from each chip. The reported values are averaged. The samples were fired at 850° C. The measured sheet resistance in ohms/sq. for the fired resistor paste 8-1 was 29,530 ohms (CV %=1.64). The hot TCR (HTCR) was −5 (sigma=0.4) and the cold TCR (CTCR) was −90 (sigma=0). This resistor example is comparable to Example 4 (Resistor paste 4-1) with two differences. Example 8 has an amorphous $SiO_2$ additive with the same glass as Example 4 and the same vol. % coated conductive content as resistor paste 1. The coated conductive was made with the same process of Example 1, but have slightly different surface areas of 11.93 and 12.40 $m^2/g$ respectively.

Example 9

Thermal Processing Latitude for Coated $RuO_2$ with Glass #4 (Table 1) with Amorphous $SiO_2$ Additive This example was previously provided in Example 5 with data provided for 850° C. firing. The resistor formulation is resistor paste D from Table 3. Additional data was attained for this sample at firing temperatures of 800, 850, and 900° C. The data is shown in the following:

Thermal Process Resistor Data

Formulated Paste D Example 5

| | Data | stats. |
|---|---|---|
| R 800° C. | 5675921 | CV % = 5.42 |
| R 850° C. | 1893896 | CV % = 2.26 |
| R 900° C. | 1073955 | CV % = 3.2 |
| HTCR 800° C. | −64.02 | σ = 4.36 |
| HTCR 850° C. | 21.15 | σ = 1.66 |
| HTCR 900° C. | 46.23 | σ = 1.42 |
| CTCR 800° C. | −137.3 | σ = 8.588 |
| CTCR 850° C. | −43 | σ = 2.69 |
| CTCR 900° C. | −16.83 | σ = 0 |

The units of R are ohms/square for 0.8×0.8 mm resistors. TCRs are reported in ppm/° C.

Comparative Example 10

Coated $RuO_2$ (5000 ppm K), (Using Glass 30 from Table 2)

The resistor conductive used in this test has been coated as described in the Example CP-1. The 5000 ppm K coated $RuO_2$ was formulated with Glass #30 (Table 2) in the following two resistor paste formulations:

| | Resistor Paste 10-1 | Resistor Paste 10-2 |
|---|---|---|
| Coated $RuO_2$ | 10.19 wt. % | 16.92 wt. % |
| Glass powder #30 Table 2 | 59.81 | 53.08 |
| Organic medium | 30.00 | 30.00 |

The two resistor pastes were mixed with a high-shear mixer at 750 RPM for 5 minutes. The pastes were then roll milled on a pressure controlled roll mill with the passes as follows: 2×open, 2×100 psi, 2×180 psi, 2×250 psi. The pastes were printed at 18 microns dry on four 1"×1" alumina substrate chips pre-terminated with Ag based conductor pads. Data was collected from 8 printed resistors from each chip. The reported values are averaged. The samples were fired at 850° C. The measured sheet resistance in ohms/sq. for the resistor paste 10-1 was 1882.8 ohms (CV %=5.44). The hot TCR (HTCR) was 813.7 (sigma=3.97) and the cold TCR (CTCR) was 833.8 (sigma=4.43). The measured sheet resistance in ohms/sq. for resistor paste 10-2 was 117.5 ohms (CV %=5.26). The HTCR was 913.6 (sigma=8.92) and the CTCR was 955.7 (sigma=4.33).

The Glass #30 Table 2 is an example of a glass having no $B_2O_3$ and a higher $SiO_2$ level compared to other glass compositions in accordance with the invention. These tests show an example of an unsuitable resistor formulation due to the selection of an inappropriate glass (TCR too high, poorer statistics). Glass #30 (Table 2) is not an example of an inventive composition of glass suited to the K coated $RuO_2$ conductive.

What is claimed is:

1. A composition comprising:

(a) One or more coated ruthenium-containing component, wherein the ruthenium-containing component comprises one or more component selected from the group consisting of: ruthenium oxide and ruthenium oxide hydrate, and wherein the coating comprises one or more acidic component, one or more basic component, or a combination thereof, said acidic component is selected from B, F, P, Se, or combinations thereof and said basic component is selected from Li, Na, K, Rb, Cs, Mg, Ca, Sr, Ba, or combinations thereof;

(b) One or more lead free glass frits, said one or more lead free glass frits comprising SiO2 3-37 wt %, Al2O3 3-13 wt %, and B2O3 11-38 wt %, based upon the weight of said one or more glass frits; and (c) An organic vehicle.

2. The composition according to claim 1, wherein the coated ruthenium-containing component has a surface area of from 5 m2/g to 25 m2/g.

3. The composition according to claim 1 wherein said coating further comprises non-acidic or non-basic components selected from Ag, Al, Cu, Nb, Si, Ta, Ti, Zn, Zr, or combinations thereof.

4. The composition according to claim 1 wherein the one or more coated ruthenium-containing component is coated by spray drying, incipient wetness, or precipitation on the surface of the one or more ruthenium-containing component.

5. The composition according to claim 1 wherein said one or more glass frits further comprises an alkaline earth oxide and said alkaline earth oxide is from about 12 wt% to about 54 wt%, based upon the weight of said one or more glass frits.

6. The composition according to claim 1, which evokes resistance values having a TCR in the range of from about −100 ppmPC to about +100 ppm/° C.

7. The composition according to claim 1 wherein said one or more glass frits further comprises one or more component selected from the group consisting of: ZrO2 0-6 wt %, and P2O5 0-13 wt % based upon the weight of said one or more glass frits.

8. The composition according to claim 1 wherein said one or more glass frits is substantially free of one or components selected from the group consisting of: alkali metals and ZnO.

9. The composition according to claim 1 wherein said one or more glass frits further comprises one compound selected from the group consisting of: CuO, TiO2, ZrSiO4, Ta2O5, Nb2O5, MnO2 and Ag2O.

10. A method of making a composition according to claim 1, comprising:

(a) coating the ruthenium-containing component, (b) calcining said coated ruthenium-containing component to form a calcined, coated ruthenium-containing component, (c) mixing said calcined, coated ruthenium-containing component with glass frit(s) and organic vehicles to form a paste; and (d) printing and firing said paste to form a thick-film resistor.

11. The method according to claim 10 wherein said coated ruthenium-containing component is coated by spray drying, incipient wetness, or precipitation on the surface.

12. A method according to claim 10 wherein said calcined, coated ruthenium-containing component has a surface area of from about 5 m2/g to about 25 m2/g.

13. A resistor formed by the method of claim 10 wherein the finished resistor has a sheet resistance of from about 10 kilo-ohms per square to about 10mega-ohms per square.

14. A resistor formed by the method of claim 10 wherein the finished resistor has a TCR in the range of from about -100 ppm/° C. to about +100 ppm/° C.

15. A lead-free resistor formed by the method of claim 10.

* * * * *